US007568420B2

(12) United States Patent
Stock

(10) Patent No.: US 7,568,420 B2
(45) Date of Patent: Aug. 4, 2009

(54) METHOD AND APPARATUS FOR MUZZLE LIFT COMPENSATION

(75) Inventor: Brian Stock, Windermere, FL (US)

(73) Assignee: Point-IP LLC, Vienna, VA (US)

( * ) Notice: Subject to any disclaimer, the term of this patent is extended or adjusted under 35 U.S.C. 154(b) by 323 days.

(21) Appl. No.: 11/467,261

(22) Filed: Aug. 25, 2006

(65) Prior Publication Data

US 2007/0131102 A1 Jun. 14, 2007

Related U.S. Application Data

(60) Provisional application No. 60/750,060, filed on Dec. 14, 2005.

(51) Int. Cl.
*F41A 21/36* (2006.01)

(52) U.S. Cl. ..... 89/14.3; 42/1.06

(58) Field of Classification Search ..... 434/18, 434/24; 89/14.2–14.5, 185, 42.01, 198, 193; 42/106

See application file for complete search history.

(56) References Cited

U.S. PATENT DOCUMENTS 749,215 A * 1/1904 McClean ..... 89/43.01
1,502,558 A * 7/1924 Andre ..... 89/14.3
1,901,138 A * 3/1933 Barnes ..... 89/14.3
4,307,652 A * 12/1981 Witt et al. ..... 89/14.3
4,480,999 A * 11/1984 Witherell et al. ..... 434/18
4,930,397 A * 6/1990 Seidler ..... 89/14.3
5,831,202 A * 11/1998 Rustick ..... 89/193
6,769,346 B2 * 8/2004 Rosenthal ..... 89/14.3

* cited by examiner

*Primary Examiner*—Michael Carone
*Assistant Examiner*—Reginald Tillman, Jr.
(74) *Attorney, Agent, or Firm*—Laurence Stein, Esq.

(57) ABSTRACT

A method and apparatus counteracts the muzzle lift of a firearm resulting from recoil, and a firearm has an integral counteracting structure. A port extends from an inner surface of the firearm barrel bore to an outer surface of the barrel, forward of the location that the propellant ignites, to an occluding structure located beneath the grip surface of the firearm. When the propellant is ignited, and the projectile passes the relief port, a portion of the propellant gas exits the bore prior to the muzzle end, travels through the propellant gas relief tube, and exerts a force on the occluding structure. The force acts downward on the firearm, counteracting the recoil-induced muzzle lift.

12 Claims, 8 Drawing Sheets

METHOD AND APPARATUS FOR MUZZLE LIFT COMPENSATION

This claims benefit of U.S. Provisional Application Ser. No. 60/750,060, filed Dec. 14, 2005, titled "Firearm Adjustable Lift Muzzle Compensator," the entirety of which is hereby incorporated by reference.

BACKGROUND OF THE INVENTION

1. Field of the Invention

The present invention relates generally to firearms and, more particularly, to a method and apparatus compensating for muzzle lift due to recoil.

2. Description of the Prior Art

It is well known in the art of firearms that when the propellant accelerates a projectile through the bore, a reactive force or "recoil," is exerted on the firearm in a direction parallel to the bore axis and opposite to the accelerating direction of the projectile. The recoil force is transferred to the person holding the firearm and, because the general construction of firearms locates the bore axis above the weapon's center of mass, and above the location that user grips the firearm, it exerts a torque moment relative to that center of mass and grip point. This recoil-induced torque causes the muzzle of the firearm to lift. Such muzzle lift, generally speaking, is more pronounced with pistols than rifles and shotguns; a pistol is typically less massive than a rifle, the vertical distance from the grip surface to the bore axis of pistol is greater than the comparable distance for a rifle and, further, a person often holds a pistol with his or her arm extended. Muzzle lift is also a problem with automatic rifles, because their rapid rate of firing exerts many successive torque impulses, making the muzzle tend to "climb."

Methods and devices are known that aim or purport to compensate for this muzzle lift. One such method is to form vents proximal to the muzzle of the firearm. Such vents extend in a generally upward direction, radial from the bore axis, exiting at an outer surface of the barrel. When the firearm is operated, the projectile travels through the bore and, after the projectile moves past the vent opening at the bore interior, a portion of the propellant gas passes through the vent and exits from the barrel in a generally upward direction, perpendicular to the bore. The exiting propellant exerts a force on the barrel, in opposite the direction that the vent extends outward from the bore center, i.e., generally downward. This force compensates, to some extent, the recoil force and resulting muzzle lift.

Muzzle vents, however, have numerous shortcomings. One is that the propellant gas exiting the vent presents a bright flash, typically directly in the user's line of sight to the target. The flash distracts the user and a causes a momentary blurring of the target image. Another shortcoming is that muzzle vents, particularly for pistols, are generally not adjustable. Therefore, the compensation force is fixed, without means for adjusting for the different physical strength and preference of different users, and without means for adjusting for different types of propellant and different projectile masses, typically referenced as "loads," that can be used with the same firearm. Still another shortcoming of muzzle vents is that the downward force resulting from propellant exiting the muzzle vents is sufficient only to partially counteract the recoil-induced torque moment. Therefore, muzzle lift is not fully compensated.

SUMMARY OF THE INVENTION

It is therefore an object of the invention to provide a method and apparatus for compensating for recoil-induced torque, and its resulting muzzle lift, without propellant gas exiting proximal to the muzzle and, therefore, without causing distraction to the user or blurring of the user's image of the target.

It is a further objective of the invention to provide and method and apparatus for recoil-induced torque with a readily adjustable compensating force, thereby accommodating different users' strength and preferences, and enabling accurate compensation for different ammunition loads.

It is a further objective of the invention to provide a method and apparatus for compensating for recoil-induced torque, and its concomitant muzzle lift, that can be embodied as an easily installed add-on kit for existing firearms.

It is a further objective of the invention to provide a method and apparatus for compensating for recoil-induced torque, and its concomitant muzzle lift, that is readily incorporated into, and integral with an existing firearm, with an inherently impact on the cost, manufacturability, parts count, and other design criteria and objectives for a firearm.

The foregoing and other features and advantages of the present invention will be apparent from the following description of the preferred embodiments of the invention, which is further illustrated in the accompanying drawings.

BRIEF DESCRIPTION OF THE DRAWINGS

The subject matter of the present invention is particularly pointed out and distinctly claimed in the claims appended to this specification. The subject matter, features, applications and advantages of the present invention will be understood and apparent from the following detailed description, viewed together with the accompanying drawings, in which:

DETAILED DESCRIPTION

Figure 1:
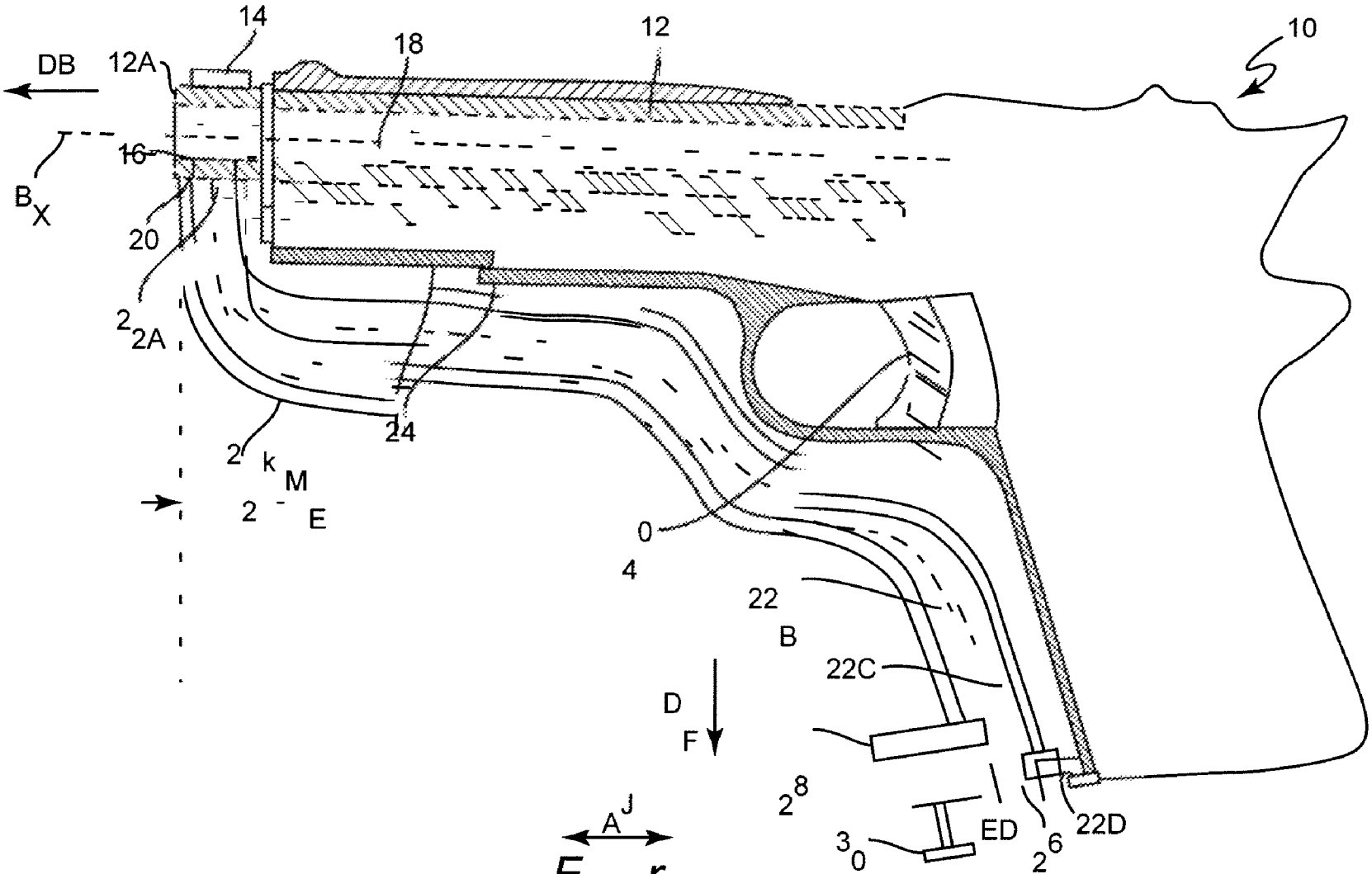
FIG. 1 is a side elevation, partial cut-away view of example embodiment of a muzzle lift compensator according to the present invention, combined with a conventional, off-the-shelf firearm, with an example of an optional adjustable lift compensation feature of the invention.

It is to be understood that the present invention is not limited to the specific examples described herein and/or depicted by the attached drawings, and that other structures, configurations and arrangements embodying the present invention can, upon reading this description, be readily designed and constructed by persons skilled in the art of firearms.

Further, in the drawings, like numerals appearing in different drawings, either of the same or different embodiments of the invention, reference structure that is identical or substantially between the different drawings.

Moreover, it is to be understood that the various embodiments of the invention, although described as different, are not necessarily mutually exclusive. For example, a particular feature, structure, or characteristic described in one embodiment may, within the scope of the invention, be included in other embodiments.

Further, it is to be understood that the terminology used herein is not limiting and, instead, is only for purposes of consistency in this description such as, for example, in referencing components, structures and the particular operation of the specific examples that are presented.

Further, as will be readily understood by persons skilled upon reading this description, certain well-known structures, materials, methods and operations of firearms are omitted, or are not described in detail, so that the description better focuses on, and avoids obscuring the novel features of the present invention.

One general embodiment of the invention comprises a conventional firearm having an added radial port extending from the inner bore surface to the outer barrel surface. A tube or other gas conduit passage extends from the outer opening of the radial port to a gas flow stop plate, such as a chamber wall, distal from the conduit's connection to the radial port. The gas flow stop plate is located, with respect to the gripping surface of the firearm, such that a force applied to it exerts a downward force on the firearm, substantially parallel to, but opposite, the torque moment exerted by the recoil force.

The radial port, gas conduit, and stop plate are constructed and arranged such that when the trigger of the firearm is actuated, the propellant ignites, expands behind the projectile and accelerates it through the bore, just as in all conventional firearms. However, the instant that the projectile passes the radial port, a portion of the expanding propellant gas enters the radial port, travels with a leading compression wave front through the gas conduit passage and impacts the stop plate.

The stop plate is dimensioned, located and arranged such that the force of the propellant's wave front impacting its surface applies a force on the firearm, preferably equal and opposite to the torque exerted by the recoil. For a pistol, such effect is obtained by locating the stop plate proximal to the lower butt of the pistol grip, because this is below the gripping surface of the grip. The desired magnitude of the counterforce can be obtained by selecting the diameter of the radial port, the length and diameter of the gas conduit, and the structure and arrangement of the stop plate, using standard engineering design methods in view of the present disclosure.

Further, an orifice or gas ejection port can be formed in the stop plate, such that a portion of the compression wave front passes through the gas ejection port, and out of the forearm, instead of applying a force to the stop plate.

Further, the magnitude of the counteracting muzzle force can be made adjustable, by arranging a movable constriction such as, for example, a plate with a cooperating guide and clamp, over the gas ejection port. The example plate is constructed and arranged such that changing its position changes its constriction of the gas ejection port. This, in effect, adjusts the surface area of the stop plate and that, in turn, adjusts the downward force applied by the propellant gas striking the stop plate.

The described invention effectively counteracts the muzzle lifting force caused by recoil, without any resulting muzzle flash, and without any negatively affect on the performance, reliability, service life, ease of repair, ease-of-manufacture or weight of the firearm.

FIG. 1 shows a partial cut-away side elevation view of an example embodiment of the present invention, comprising a standard, off-the-shelf firearm, shown as a pistol 10, wherein the firearm has only one preferred structural characteristic for ease of use with the FIG. 1 embodiment of the present invention, which is that the muzzle end of the barrel tube 12 extends a distance ME from the stock or slide of the firearm sufficient to support the barrel band 14, the band being described in greater detail below. The ME requirement is of little, if any, significance because, as will be ascertainable and understood by persons of ordinary skill in these arts upon reading this disclosure, there are many types, varieties, models and manufacturers of firearms having a barrel protrusion satisfying this ME requirement. Otherwise, the firearm, shown as a pistol 10 in the FIG. 1 example, can be of any known type including, but not limited to, a gas-operated semi-automatic, recoil-operated semi-automatic, revolver or even a single shot type.

It will be understood that the specific type, form and style of the pistol shown in FIG. 1 as item 10 is only an example, and that substantially any type can be used, and that the other items and structures are, as a preferable design choice, shaped and sized to reasonably conform to the pistol 10, for ergonomic and aesthetic reasons readily apparent to persons skilled in the art of firearms upon reading this disclosure.

Further, as will be readily understood by persons skilled in the arts pertaining to this invention, upon reading this disclosure, the ME barrel protrusion requirement does not pertain to all embodiments described herein.

With continuing reference to FIG. 1, a port 16 extends through the wall (not separately numbered) of the barrel tube 12 into the bore 18. The port 16 is the only actual modification to the firearm itself required for the FIG. 1 embodiment. In the FIG. 1 example, the port 16 is proximal to the muzzle end 12A of the barrel 12, but this location is only for cooperation with the FIG. 1 example muzzle location of the barrel band 14. Other described embodiments employ at least one port, functioning as port 16 functions, at any location along the length of the barrel back to the position of a chambered projectile (not shown in FIG. 1).

Referring to FIG. 1, the port 16 can be formed by, for example, drilling. The diameter of the port 16 is preferably large enough to permit an adequate pressure or shock wave front of the propellant to pass through unimpeded, as will be further understood from the description below, and is preferably not significantly larger than the diameter of the bore 18, to avoid interference with the spin and stability of the projectile when passing over the port.

Referring again to FIG. 1, a barrel band 14 having a connector port 20 surrounds the barrel 12, such that the connector port 20 aligns with the bore port 16. The bore diameter (not separately labeled) of the barrel band 14 is preferably only slightly larger than the outer diameter (not separately labeled) of the barrel 11. The length of the barrel band (not separately labeled) is a design choice such as, for example, slightly less than the barrel protrusion length ME.

There are two guidelines for setting the clearance between the inner bore of the barrel band 14 and the outer surface the barrel 12, and a person of ordinary skill in the art of firearms can readily determine an optimum clearance value in view of these. The first is that the clearance should not be so large that excessive propellant gas escapes through the clearance instead of entering the connector port 20. Such an excess of escaping propellant could, conceivably, if large enough, permit a possibly distracting ring-shaped flash to exit back toward the user.

The second guideline is determined by whether or not the barrel 12 must move in relation to the frame (not separately numbered) of the firearm 10 or in relation to the barrel band 14 in order for the firearm to properly operate. For example, as is well known in the art, if the firearm 10 is a semi-automatic pistol then the barrel 12 may have a necessary downward movement and/or rearward movement, i.e., toward the breech, each time the pistol is fired. As known in the art, there are types of semi-automatic pistols in which such movement is necessary so that, for example, the barrel 12 disengages the barrel 12 from the slide (not separately numbered), thereby allowing the slide to move sufficiently rearward to allow ejection of the spent cartridge (not shown) and chambering of a new cartridge, before being urged back to its pre-firing position by a spring (not shown). Therefore, if an apparatus according to this invention, as depicted by FIG. 1, employs a pistol 10 requiring such movement of the barrel 12, there must be sufficient clearance between the inner bore of the barrel band 14 and the outer surface of the barrel 12 such that the motion is not impeded. An example clearance, which the present inventor observed as allowing proper operation of a "Model 1911" .45 caliber semi-automatic pistol, well known in the art of firearms, is approximately 0.003 inches, plus approximately 0.001 inches, minus approximately zero.

The above example clearance value is only an example and, as can be easily understood by a person of ordinary skill in the art of firearms upon reading this disclosure, the actual choice of clearance will further consider, for example, the length of the barrel band 14, and the difference, if any, between the coefficient of thermal expansion of the metal, or other material, of the barrel band 14 and the coefficient of thermal expansion of the barrel 12.

Further, it will be understood that the above-described clearance is not necessary if the barrel 12 does not, or cannot, move in relation to the frame of the firearm. Examples of such firearms include, but are not limited to: revolvers, bolt-action pistols, break-action single-shot pistols, and gas-operated submachine guns.

Referring to FIG. 1, a propellant relief tube 22 extends from location 22A at the outer end of the connector port 20, along, in this example, the underside 24 of the pistol 10, and then opens through a lower inner port 22B into a lower chamber 22C. The lower chamber 22C has a lower surface 22D. A gas exit port 26, having diameter ED, extends through the lower surface 22D of the lower chamber 22C. The lower surface 22D may be integral to the tube 22 or may be a separate plate (not separately shown) attached by, for example, welding or by screws (not shown) extending upward, through clearance holes (not shown) in the plate and threaded into the threaded holes (not shown) extending within and parallel to the walls of the tube 22.

The FIG. 1 example embodiment includes a feature for adjusting the effective diameter of the gas exit port 26, and depicts one example structure for this feature. Other examples will be described. The FIG. 1 example structure for the varying the effective diameter of the gas exit port 26 is a movable stop plate 28, which will be described in reference to the enlarged view shown by FIG. 2.

Figure 2:
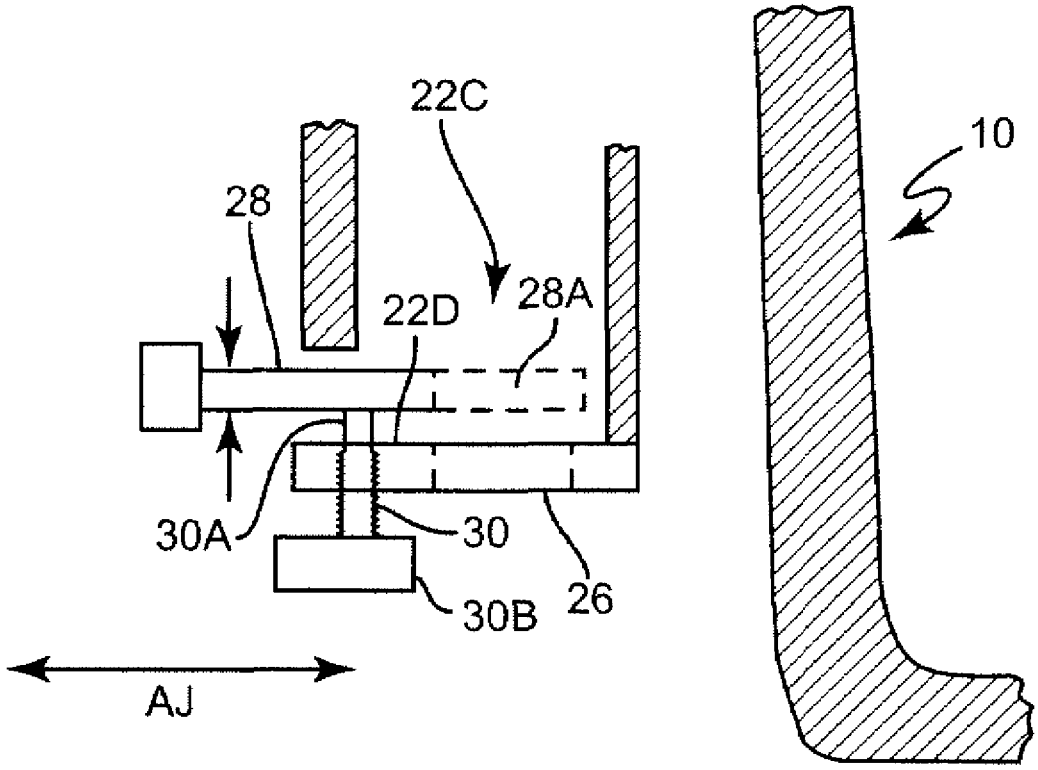
FIG. 2 is an enlarged cut-away elevation view of an example optional adjustable lift compensation feature of the FIG. 1 embodiment of the invention.
Figure 3:
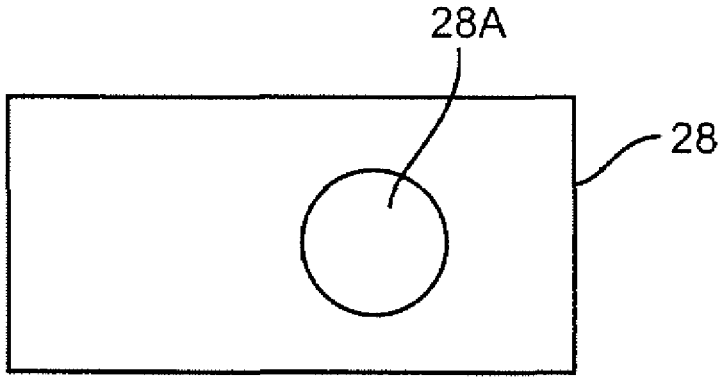
FIG. 3 is a top projection view of the example linearly movable stop plate component, shown in FIG. 2, of the FIG. 1 example optional lift compensation feature.

Referring to FIG. 2, an example structure for varying the effective diameter of the gas exit port 26 is the movable stop plate 28, having a thickness SD, supported by a pair of laterally opposed guide slots or grooves (not separately labeled), each slot having a height slightly larger than the thickness SD, so that the stop plate 28 is manually movable in the AJ direction. FIG. 3 shows a top elevation view of an example structure for the movable stop plate 28. Referring to FIG. 3, the example movable stop plate 28 has an adjustment port 28A, having a diameter preferably slightly larger than the diameter of the gas exit port 26. Referring to FIGS. 2 and 3, it is seen that moving the movable stop plate 28 in the AJ direction moves the relative alignment between the adjustment port 28A and the gas exit port 26. If the movable stop plate 28 is slid in the AJ direction to a position where the adjustment port 28A fully aligns with the gas exit port 26 then the effective diameter of the gas exit port 26 is unchanged. If the movable stop plate 28 is slid further, in either AJ direction, the resulting misalignment of the adjustment port 28A and the gas exit port 26 results in a corresponding lessening of the effective diameter of the gas exit port 26. Stated differently, the movable stop plate 28 partially or, if moved sufficiently, completely blocks or occludes the gas exit port 26.

Referring to FIG. 2, a thumbscrew 30 or equivalent having, for example, a threaded portion (not separately labeled) engages with a threaded through hole (not separately labeled) formed in the lower surface 22D of the lower chamber 22C. Tightening the thumbscrew 30 by, for example, manually rotating the projection 30B, causes its distal end 30A to contact the stop plate 28. This, in turn, presses the stop plate against the upper ledge (not separately numbered) of the guide slots, thereby locking the stop plate 28 in a desired position in the AJ direction.

It will be understood that the thumbscrew 30 is only an example structure for locking the movable stop plate 28. Alternative structures include, but are not limited to, a lever-actuated cam (not shown) arranged in the lower surface 22D of the lower chamber 22C under the movable stop plate 28, such that manual actuation of the lever causes the cam to exert an upward force on the movable stop plate 28.

It will be understood that the movable stop plate 28 may be omitted, to obtain a non-adjustable, muzzle-lift compensated firearm according to the present invention. Such an embodiment may, by selecting the diameter for the lower gas ejection port 26 in view of the mass of the firearm, and the caliber and anticipated range of loads of the ammunition (not shown), provide adequate muzzle lift compensation. Further, the lower gas ejection port 26 may be omitted, i.e., forming the lower chamber 22C as a closed chamber. This provides a non-adjustable, muzzle-lift compensated firearm according to the present invention with, assuming other parameters being equal, a greater muzzle lift compensating force than that provided by an embodiment having the port 26.

Regarding materials, the FIG. 1 barrel band 14 and propellant bypass tube 22 may be constructed of any materials known in the art of firearms for conduits of expanding propellant gas such as, for example, aluminum, polymer and/or stainless steel. The movable stop plate 28 may be constructed of, for example, stainless steel.

An example operation of the FIG. 1 example embodiment will now be described. First, the trigger 40 or equivalent firing mechanism is pulled or otherwise actuated. Then via any of the various structures, types and/or classes of trigger or firing mechanisms known in the art, this causes a firing pin (not shown) or equivalent to strike the primer (not shown) of a cartridge (not shown) or equivalent propellant-projectile arrangement. As known in the art, when the firing pin or equivalent strikes the primer, the primer ignites and, in turn, this ignites the gunpowder (not shown) or other type of propellant contained in the cartridge, or that is otherwise arranged behind the projectile (not shown).

Upon its ignition, the propellant changes into a rapidly expanding gas, which urges the projectile through the bore 18, in the direction labeled DB. As known in the art, the propellant acting against the projectile produces an equal but opposite force against the breach (not shown) of the pistol 10. In the FIG. 1 embodiment, though, the instant the projectile passes beyond the entry (not separately numbered) of the bore port 16, the port 16 provides an alternate path for the expanding propellant gas. This alternate path for the expanding propellant gas has a much lower resistance than the rear surface of the projectile and, therefore, a fast-moving compression wave of the propellant gas enters the bore port 16, passes through the connector port 20, and into the upper end 22A of the propellant gas relief tube 22. The compression wave front progresses rapidly, along the direction line DG, past the lower port 22B, into the lower chamber 22C and strikes the movable stop plate 28.

It will be assumed, for purposes of example, that the movable stop plate 28 is positioned in the AJ direction such that the gas exit port 26 is completely blocked occluded.

When the compression wave front strikes the inner face (not separately numbered) of the movable stop plate 28, it exerts a substantial force on the plate, in the direction DF, which is normal to the plane (not separately numbered) of the face of the movable stop plate 28. The direction DF is downward relative to the barrel 12 and, therefore, this force of the propellant gas compressive wave front striking the movable stop plate 28 pushes downward on the pistol 10, counteracting the muzzle lift due to the recoil force described above. The speed of the propellant gas compressive wave front is such that it travels from the port 16, strikes the movable stop plate 28 and thereby provides a downward force quickly enough to substantially reduce, or even cancel, the muzzle lift caused by the recoil force.

The magnitude and timing of the downward force, counteracting the recoil-induced muzzle lift, is determined by several variables, and the values for these are obtained by straightforward methods and calculations, readily performed by persons of ordinary skill in the art upon reading this disclosure. These variables include, for example, the rate of expansion of the propellant gas when arriving at the opening of the bore port 16 into the bore 18, the diameter of the bore port 16, the inner diameter BP of the propellant gas relief tube 22, the path length (not separately labeled) from the location 22A to the stop movable stop plate 28, the combined surface area of the portion of the movable stop plate 28 extending into the lower chamber 22C, and the area (if any) of the lower surface 22D of the lower chamber 22C, the angle (not separately numbered) between the plane of the movable stop plate 28 and the bore axis BX, and the location of the movable stop plate 28 with respect to the grip surface 10A of the pistol 10.

The example operation above assumed that the movable stop plate 28 was positioned to completely block the gas ejection port 26. With continuing reference to FIG. 1, if the adjustment plate 28 is positioned, in the AJ direction, such that the adjustment port 28A is substantially aligned with the gas ejection port 26 a substantial portion of the compression wave front of the propellant gas will pass through the port 26, without exerting a downward force on the firearm. If, on the other hand, the adjustment plate 28 is positioned in the AJ direction such that the adjustment port 28A partially closes, or occludes, the gas ejection port 26, it will exert a correspondingly larger force on the adjustment plate 28 and, in turn, will exert a correspondingly larger downward force on the pistol 10, and that will more strongly counteracting the recoil-induced muzzle lift.

It will be understood that the range of adjustment in the counteracting force obtained by the above-described example is, at least in part, a design choice, determined by, for example, the range of motion of the adjustment plate 28.

The described adjustment structure comprising the depicted movable stop plate 28 with its adjustment port 28A is only an example for adjusting the occlusion of the propellant gas passing through the lower chamber 22C and out through the gas ejection port 26. Example alternative structures will be described and, further, other examples and variations will be readily understood by persons of ordinary skill in the firearm arts upon reading this disclosure.

Figure 4:
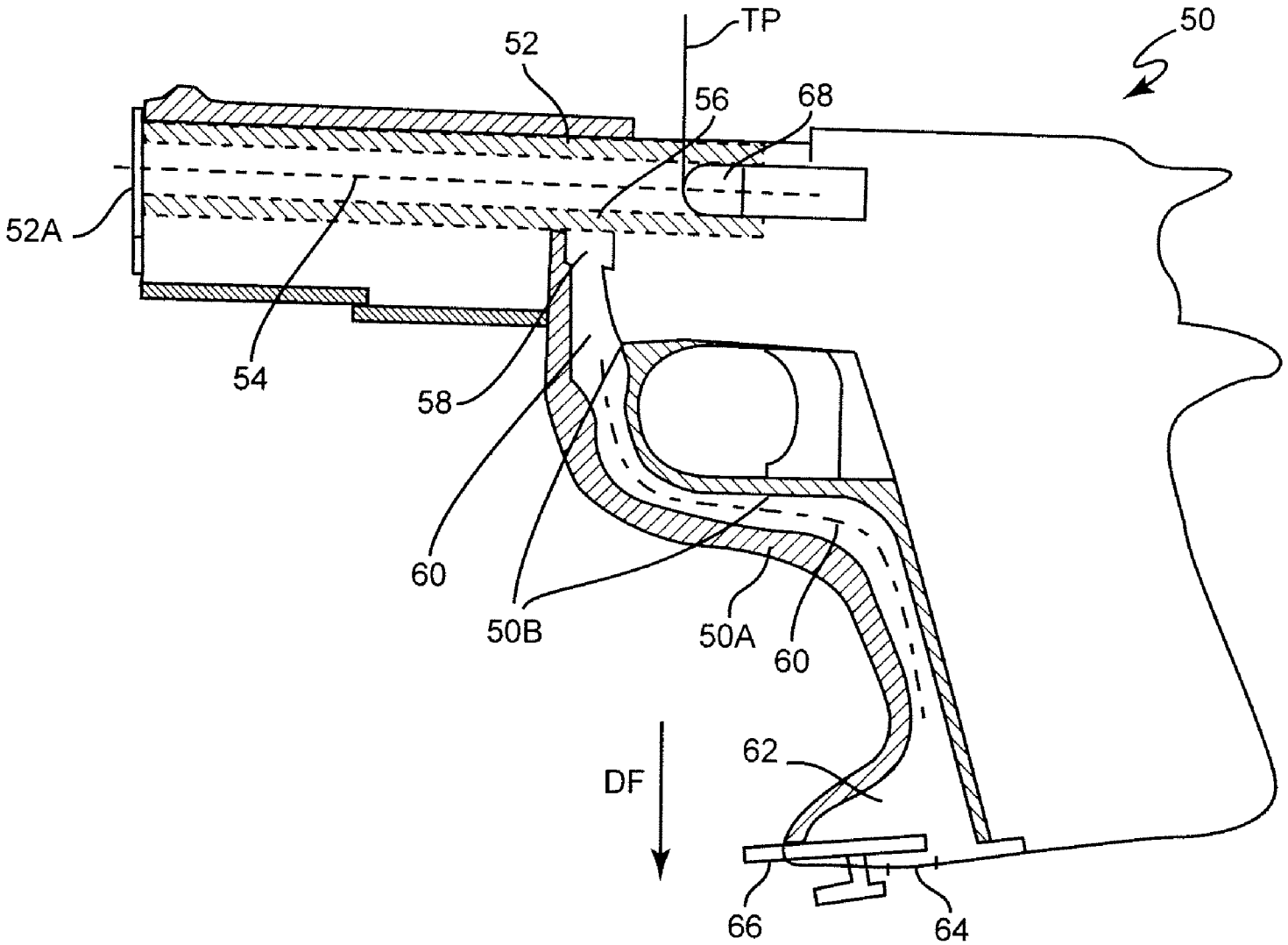
FIG. 4 is a side elevation, partial cut-away of an example embodiment of a integrated muzzle lift compensated firearm according to the present invention, having an example adjustable lift compensation feature.

FIG. 4 depicts an example embodiment having the muzzle-lift compensating mechanism integral to the firearm, instead of being an add-on accessory or modification. It will be understood that the FIG. 4 embodiment is depicted in a pistol form 50 but, like the pistol 10 of the FIG. 1 embodiments, the illustrated form and type of the firearm 50 is only an example for purposes of describing an integrated muzzle lift compensated firearm according to this invention, thereby enabling a person of ordinary skill in the art to design, construct and use an integrated muzzle lift compensated firearm, of any type, e.g., a revolver, submachine gun or rifle, according to the present invention.

With continuing reference to FIG. 4, the firearm 50 has a barrel tube 52, a bore 54, and a bore port 56 extending in a radial direction through the barrel tube 52, into an upper chamber 58 arranged under the barrel tube 52. A propellant gas bypass tube 60, formed, in the depicted example, by a lower structural member 50A and an upper structural member 50B of the firearm 50, extends from the upper chamber 58 to a lower chamber 62. A lower gas ejection port 64 may be formed in the bottom of the lower chamber 62. A movable stop plate 66 having an adjustment port (not numbered) may be supported by, for example, a pair of opposing slots or grooves (not shown) formed in the inner sidewalls (not separately numbered) of the lower chamber 62. A thumbscrew 65 may be used to secure the movable stop plate 66, and may be according to the structural description of the thumbscrew 30 of the embodiments described above in reference to FIGS. 1-3. The movable stop plate 66 and the cooperating slots or grooves in the inner sidewalls of the lower chamber 62 that accommodate the plate 66 may, for example, be structurally identical to the movable stop plate 28 and corresponding structure described above in reference to FIGS. 1-3.

The bore port 54 can be located anywhere from a position just forward of the tip position TP of the chambered projectile 68 to a position proximal to the muzzle end 52A. The FIG. 4 example shows the bore port 56 proximal to the tip position TP because, at least for certain types of larger caliber semi-automatic pistols, a position proximal to TP enables a less complex or easier to incorporate structure for the propellant bypass tube 60.

Referring to FIG. 4, the movable stop plate 66 may be omitted, which results in a non-adjustable, muzzle lift compensated firearm. Likewise, the lower gas ejection port 64 may be omitted, which results in a non-adjustable, muzzle lift compensated firearm having a greater compensating force.

FIGS. 5, 6, 7, 8A, 8B and 9 show enlarged views of an example alternative to the movable stop plate 66 for varying the occlusion or blockage of the lower gas ejection port 64, thereby providing an alternative adjustable lift compensation feature according to the present invention. The example alternative occlusion embodiment of FIGS. 5-9 is drawn as a modification of the FIG. 4 embodiment, but can it can also substitute for the stop plate 28A structure depicted by FIGS. 2 and 3 and therefore be used with the FIG. 1 embodiment.

Figure 5:
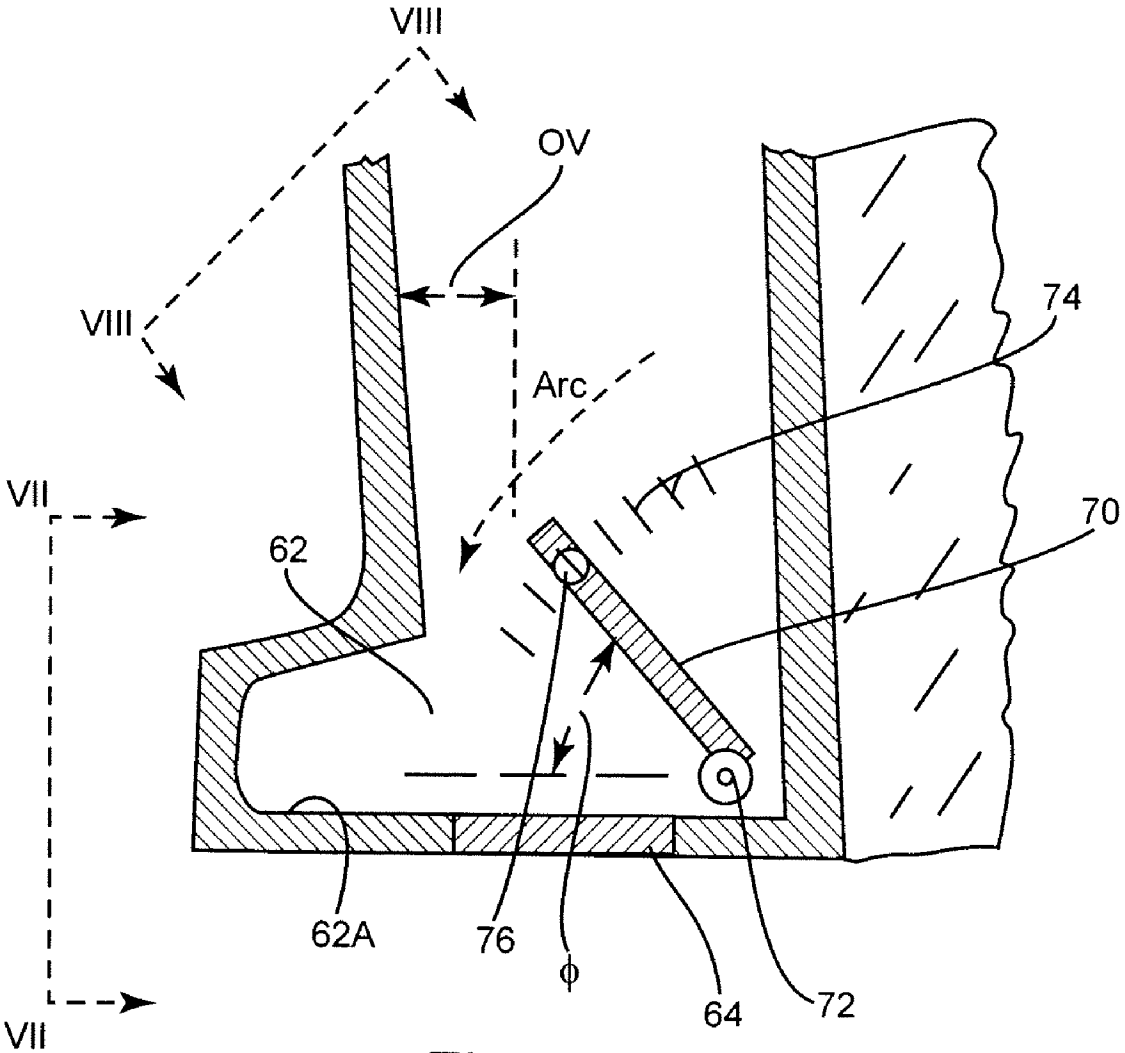
FIG. 5 is an enlarged cut-away elevation view of an example alternative structure for an optional adjustable lift compensation feature, combinable with the FIG. 1 or the FIG. 4 embodiment of the invention.
Figure 6:
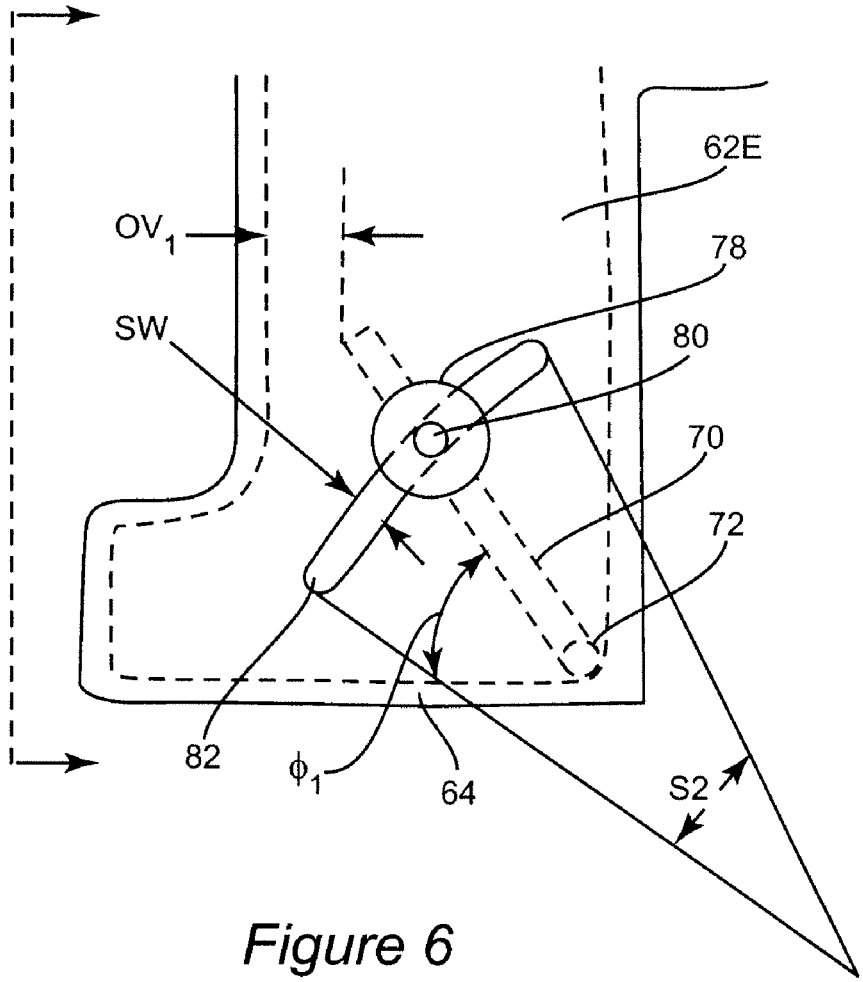
FIG. 6 illustrates the structure according to FIG. 5, from the same viewing angle and scale as FIG. 5, seen with the left side of the lower chamber in place.
Figure 7:
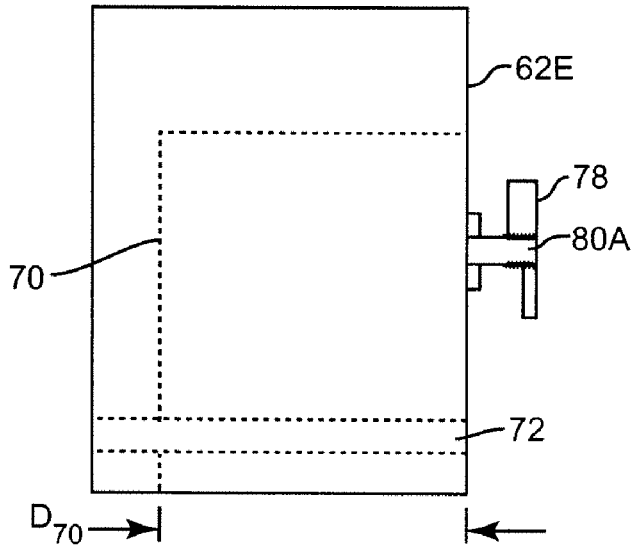
FIG. 7 illustrates the structure according to FIG. 5, in the VII-VII viewing projection plane of FIG. 5.

FIG. 5 shows a cut-away elevation view of the example alternative occluding structure, viewed in the plane of FIG. 4, with the left side of the lower chamber 62 removed. FIG. 6 illustrates the same structure, from the same viewing angle and scale as FIG. 5, seen with the left side of the lower chamber in place. FIG. 7 illustrates the structure, in the VII-VII viewing projection plane of FIG. 5, and FIG. 8 is a further enlarged cut-away projection in the VIII-VIII projection plane of FIG. 5. FIG. 9 illustrates the same structure, from the same viewing angle and scale as FIG. 5, with the occlusion adjusted to a different value.

Referring to FIG. 5, the example includes a pivoting stop plate 70, rotatable in the ARC direction to a desired angle $\phi$ with respect to the plane of the lower wall 62A of the chamber 62. A pivot pin 72 may be used, having its two ends (not separately numbered) supported, respectively, by supporting holes (not separately numbered) in the sidewalls of the lower chamber 62. The pivoting stop plate 70 may be structured and arranged to rotate around the pin 72, with the pin ends being secured by, for example, press fitting into the sidewalls of the lower chamber 62. Alternatively, the opposite ends of the pin 72, and the cooperating holes in the sidewalls of the lower chamber 62, may be structured and arranged such that the pin 72 rotates.

With continuing reference to FIG. 5, a plurality of closely-spaced grooves or notches may be formed in the inner face of the sidewall removed by the FIG. 5 cut-away, at the locations labeled 74, and an example form of the grooves or notches, and the co-operating edge of the pivoting stop plate 70 that engages with a selectable one of the grooves or notches is described in further detail below in reference to FIG. 8. A threaded hole 76, or a threaded male pin (not shown) may be formed in the pivoting stop plate, extending in a direction normal to the FIG. 5 plane.

Referring to FIG. 6, a thumbscrew 78 may have a threaded male end (not shown in FIG. 6) that is threaded into the threaded hole 76 in the pivoting stop plate 70, as shown in FIG. 5, or may have a threaded through hole at its center 78A that threads onto a threaded male pin 80, the pin 80 being attached by, for example, a threaded insert or welding, to the pivoting stop plate 70. An arced slot 82 is formed in the sidewall 62E of the lower chamber 62, extending in the ARC direction shown in FIG. 5 for an arc length $\Omega$ of, for example approximately 30 degrees. With continuing reference to FIG. 6, the arced slot 82 has a width SW, preferable slightly larger than the diameter (not numbered) the threaded male pin 80 extending outward from the pivoting stop plate 70 through the slot 80, or the portion (not shown in FIG. 6) of the thumbscrew 78 that extends through the slot 80 when the threaded distal end of the thumbscrew (not shown in FIG. 6) is threaded into the threaded hole 76 formed in the pivoting stop plate 70.

Figure 8A:
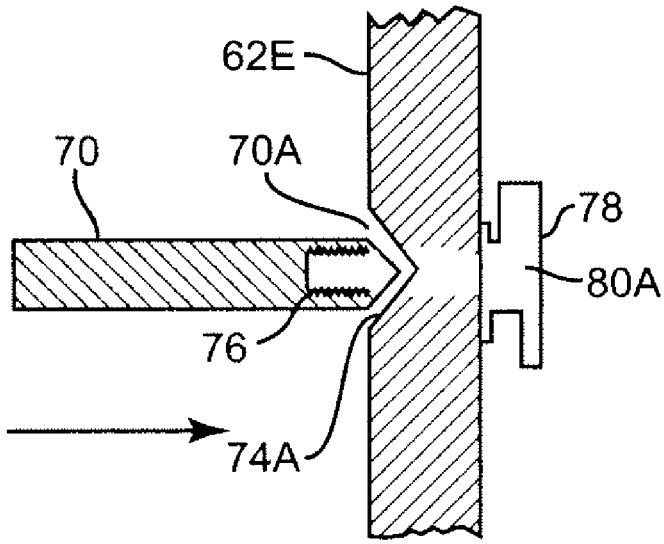
FIG. 8 is a further enlarged cut-away projection in the VIII-VIII projection plane of FIG. 5.
Figure 8B:
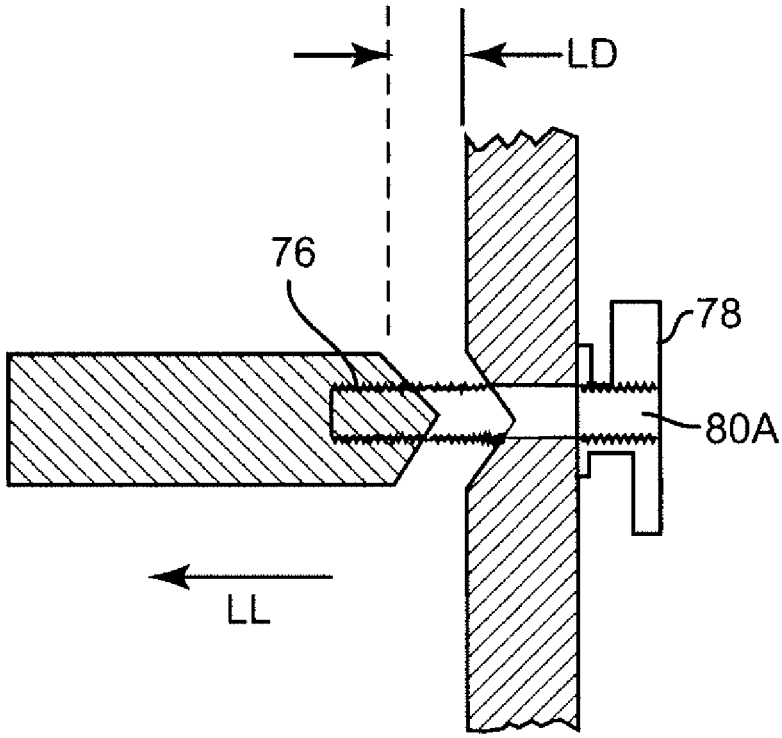
Figure 9:
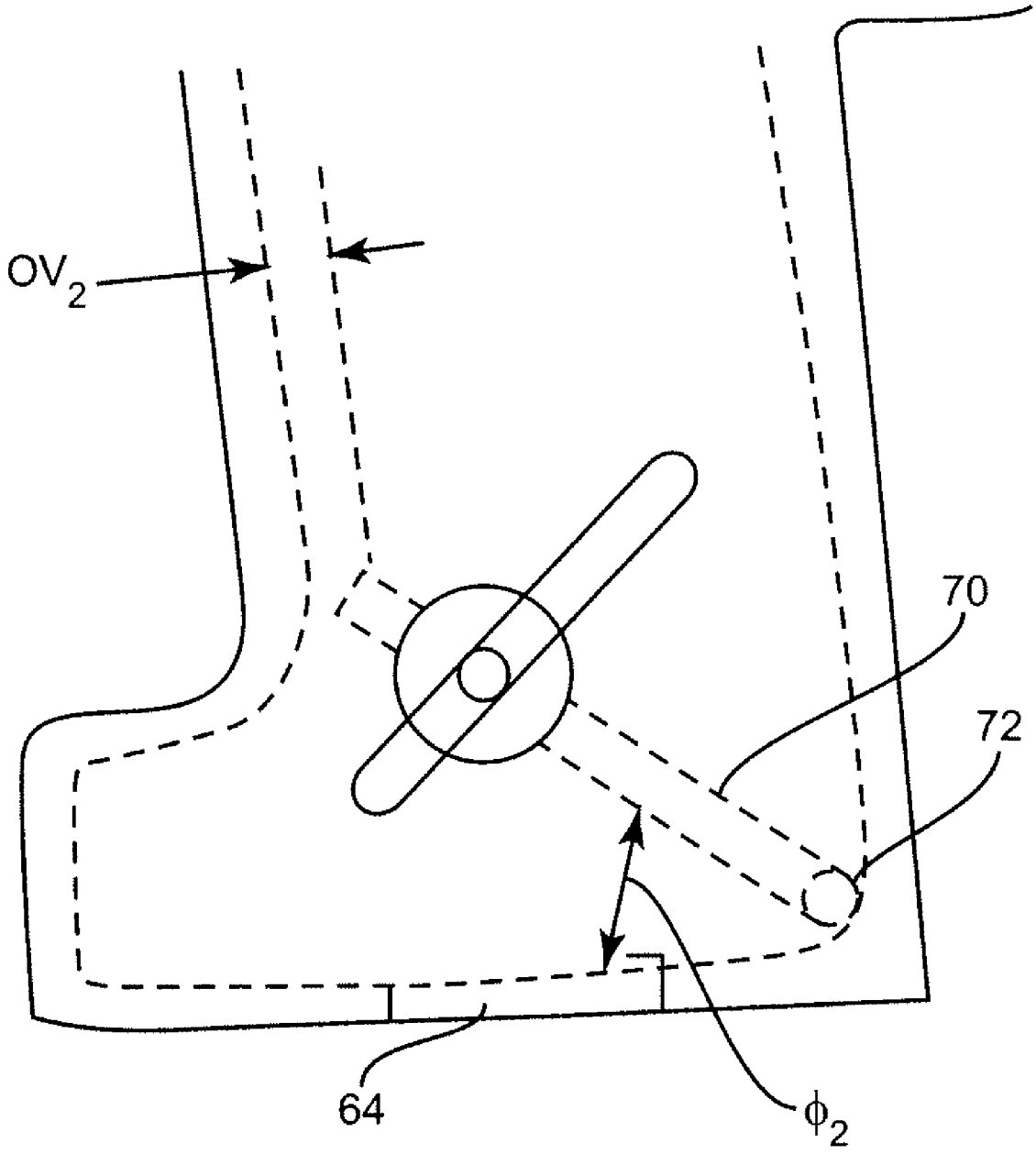
FIG. 9 illustrates the structure according to FIG. 5, from the same viewing angle and scale as FIG. 5, with the occlusion adjusted to a different value.

FIGS. 7, 8A and 8B, and 9 viewed in conjunction with FIGS. 5 and 6, illustrate an example structure and arrangement such that loosening the thumbscrew 78 allows the pivoting stop plate to move a distance LD, see FIG. 8A, in a direction LL parallel to the axis of pin 72, sufficient for the edge 74A of the pivoting stop plate 70 to disengage from the groove or slot 74A and rotate, along the ARC direction shown in FIG. 5, to a desired $\phi$ position at which another of the slots or grooves is formed and then, by tightening the thumbscrew 78, the pivoting stop plate 70 is urged in the FIX direction, see FIG. 8B, to engage and secure the edge 70A of the plate into the appropriate slot or groove. The structure is described using a pin 80 having extending out from the edge 70A of the pivoting stop plate 70, through the slot 82, and the thumbscrew 78 having a threaded through hole (not numbered) that engages with the threaded end 80A of the pin 80. The description, however, readily enables a person of ordinary skill in the art to use a thumbscrew 78 having a threaded distal end (not numbered) inserted into a threaded hole, such as the hole illustrated in FIG. 5 as item 76.

Referring to FIG. 6, the pivoting stop plate 70 is assumed as secured at a $\phi_1$ position, by the thumbscrew 78 being tightened so as to urge the stop plate 70 edge 70A into a particular groove or slot 74A, as shown in FIG. 8A. This provides an occlusion spacing of $OV_1$. When the firearm 50 is operated in this adjustment, a portion of the propellant compressive wave will strike the upper surface of the pivoting stop plate 70, and a portion will pass through occlusion spacing of $OV_1$ and then through the lower gas ejection port 64. Similar to the movable stop plate 66 of the FIG. 4 embodiment, the occlusion spacing $OV_1$ determines the effective diameter of the lower gas ejection port 66 and, hence, the affects the compensating force exerted downward on the firearm 50.

Referring to FIG. 8B, the thumbscrew 78 is loosened, thereby allowing the pivoting stop plate to move a distance LD in the LL direction. The required distance LD is determined by the depth of the groove or slot 74A. A person of ordinary skill in the art can easily construct and arrange the pivoting stop plate 70 to move at least the LD distance upon loosening the thumbscrew 78 by, for example, selecting a width $D_{70}$, see FIG. 7, of the pivoting stop plate 70, and by selecting a rigidity for the sidewalls of the lower chamber 62.

Referring to FIG. 9, the pivoting stop plate 70 is then moved by pushing the thumbscrew 78 to forward such that the pin 80 moves in the slot 82 to a new angular position, labeled $\phi_2$, at which point the thumbscrew 78 is tightened, thereby urging the edge 70A of the pivoting stop plate 70 into the slot 74A aligned at the $\phi_2$ position. Referring to FIG. 5, since the locations 74 of the slots or grooves 74A are discrete, the values of $\phi$ are discrete as well. Referring to FIG. 9, moving the pivoting stop plate 70 to the $\phi_2$ position results in a new occlusion spacing, labeled $OV_2$. Since $OV_2$ is smaller than $OV_1$, the adjustment position illustrated by FIG. 9 will, assuming other parameters being equal, provide a greater counteracting force than the $\phi_2$ and $OV_1$ occlusion spacing shown in FIG. 5.

Regarding materials, the structure of the FIG. 4 firearm 50 forming propellant gas bypass tune 60, such as the example surface 50A and 50B, can may be constructed of any materials known in the art of firearms for conduits of expanding propellant gas such as, for example, aluminum, steel, polymer and stainless steel. The pivoting stop plate 70, likewise, may be constructed of, for example, stainless steel, aluminum or any equivalent thereof.

Referring to FIGS. 5-9, a sealing structure (not shown) such as, for example, a flexible rubber or plastic gasket (not shown), may be arranged within the lower chamber 62 to cover portions of the slot 82 through which the pin 80 does not extend, to lessen or prevent escape of propellant gases through the slot 82 when the firearm 50 is fired. The sealing structure may be constructed and arranged such that the compressive shock wave of the propellant gas in the lower chamber 62 urges the structure to a position that seals such portions of the slot 82. The sealing structure is a design choice, as a person of ordinary skill can, upon reading this disclosure, readily design and construct such a structure.

Figure 10B:
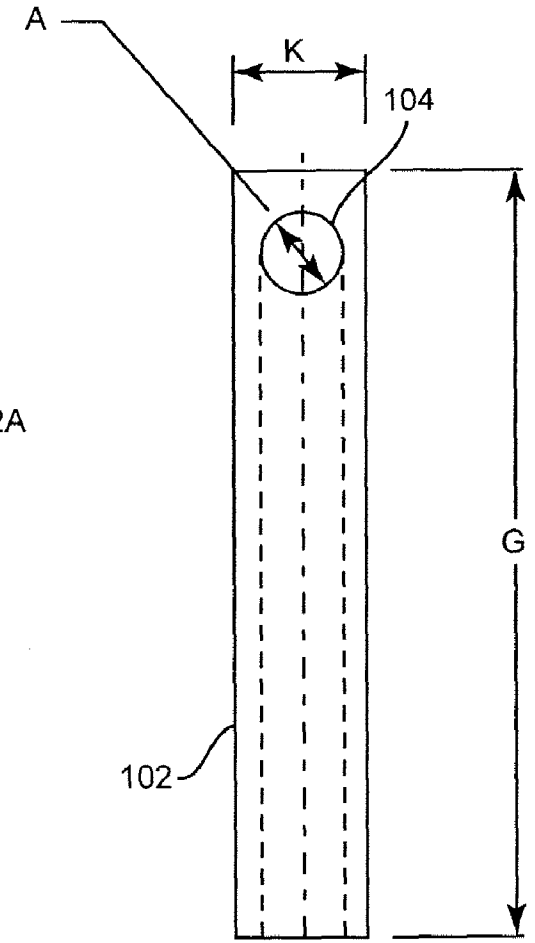
FIGS. 10A and 10B show a side cut-away and front projection view, respectively, of an example embodiment of a muzzle lift compensator according to the present invention, for installation on a conventional pistol.
Figure 10A:
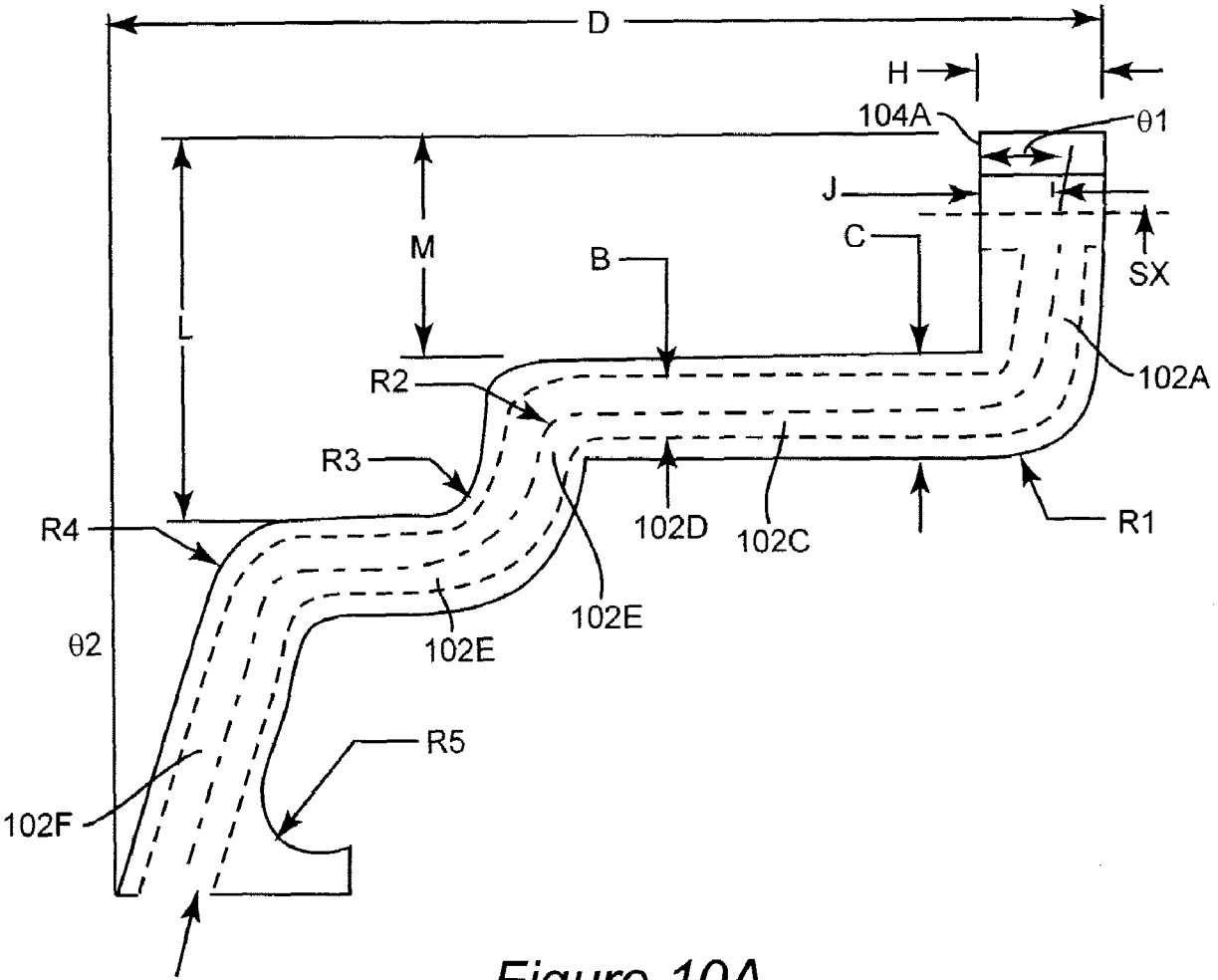

FIGS. 10A and 10B (collectively referenced as "FIG. 10") show a cut-away side view and a front projection view, respectively, of an example apparatus generally referenced as item 100, having a combination of a propellant gas relief tube 102, comparable to the propellant gas relief tube 22 shown in FIG. 1, and a barrel sleeve bore 104, comparable to the inner bore (not separately numbered) of the barrel band 14 shown in FIG. 1. The apparatus of FIGS. 10 is for installation on, for example, a conventional pistol such as the example pistol 10 depicted by, and described above in reference to, FIG. 1.

Referring to FIG. 10B, the diameter A of the barrel sleeve bore 104 is set in accordance with the outer diameter of the muzzle end (not show) of the pistol (not shown) on which the apparatus 100 is to be installed.

Referring to FIG. 10A, the propellant gas relief tube 102 extends from its intersection 102A with the barrel sleeve bore 104 to a lower gas ejection port 102B, comparable to the gas ejection port 26 of the FIG. 1 embodiment. The propellant gas relief tube 102 has a general inner diameter B, which is preferably set to approximate the bore diameter (not shown) of the pistol onto which the apparatus is installed. The path of the depicted propellant gas relief tube 102 begins with section 102A, which extends at an angle θ1 with respect to the axis SX of the barrel sleeve bore 104, and then curves with an outer radius R1 into section 102C that extends in a substantially horizontal direction, then vertically downward as sections 102D and 102E, in an "S"-shaped manner, having radii R2 and R3, ending with a section 102F. The section 102F extends at an angle θ2 with respect to the vertical.

With continuing reference to FIG. 10A, the depicted propellant gas relief tube 102 has a general outer diameter C, which is determined, in part, by the bore diameter A, the material from which the structure 102 is formed, and by ergonomic factors particular to the specific pistol on which it is installed. Likewise, the overall length D, the length of the drops E, F, L and M and, referring to FIG. 10B, the overall height G, are determined, in significant part, by form and shape factors particular to the specific pistol on which it is installed.

Referring to FIG. 10A, the length H of the barrel sleeve bore is chosen, in significant part, according to the length (not shown in FIGS. 10, but described above in reference to FIG. 1 as "ME") of the protruding muzzle end of the barrel onto which the apparatus 100 is installed. The spacing J between the back face 104A and the center of the tube section 102A is set to align with a bore port (not shown), that is comparable to the bore port 16 of the FIG. 1 embodiments, that is drilled or otherwise formed in the pistol to which the apparatus 100 is installed.

Referring to FIG. 10B, the width K is determined, in significant part, by form and shape factors particular to the specific pistol on which it is installed.

The example structure depicted by FIGS. 10*a* and 10*b* may be constructed of any of the various materials known to those of ordinary skill in the art of firearms manufacture. Further, regarding methods of manufacture, the structure depicted by FIGS. 10*a* and 10*b* may be made by, upon reading this disclosure, by methods known to those of ordinary skill in the arts pertaining to firearms manufacture such as, for example, casting with a polymer resin and, if desired, casting such that a thin stainless steel tubing (not shown) lines the interior surface of the tube 102. Finish machining may be used such as, for example, the bore 104, to give a proper fit and appearance.

While certain embodiments and features of the invention have been illustrated and described herein, many modifications, substitutions, changes, and equivalents will occur to those of ordinary skill in the art.

For example, referring to FIG. 1, it will be understood that the barrel band 14 is only an example structure and method for connecting the bore port 16 to the upper location 22A of the propellant gas relief tube 22. Alternative structures and methods will be readily apparent to persons skilled in the firearm art upon reading this disclosure. For example, for a firearm having an equivalent to barrel 12 that does not or cannot move with respect to the frame (an example of such a firearm being a standard revolver barrel) then, instead of using barrel a structure such as a band 14 and connector port 20, the upper end 22A of the propellant gas relief tube may be threaded into, onto by use of a threaded barrel connector (not shown), or otherwise connected directly into the port 16. Further, in the FIG. 1 embodiment, the port 16 may extend through the barrel tube 12 at a direction other than the depicted downward direction.

Likewise, referring to FIG. 4, an integrated muzzle lift compensated firearm according to the present invention may employ an equivalent of port 56 that extends, for example, from the side of the barrel 52 instead of downward, by constructing an equivalent to the upper chamber 58 for fluid connection of the side equivalent of the port to the propellant gas relief tube 60 or equivalent thereto.

Further, the adjustable occlusion structures such as, for example, those depicted at FIGS. 2, 3 and 5, may be installed at locations other than proximal to the lower gas ejection ports 26 and 64.

It is therefore to be understood that the appended claims are intended to cover all such modifications and changes as fall within the spirit of the invention.

I claim:

1. A muzzle lift cancellation apparatus for a firearm having a given center of mass, the firearm having a frame supporting a barrel, a grip attached to the frame, the barrel having a barrel wall surrounding a bore extending along a longitudinal axis between a breach end bore opening and a muzzle end bore opening, and having a structure for supporting, at an ignition location proximal to the breach end bore opening of the barrel, a projectile and a propellant for the projectile, and having a trigger mechanism for selectively igniting the propellant to form an expanding propellant gas having a given compression wave front urging the projectile and applying a given associated torque moment to the firearm about the given center of mass, the apparatus comprising:

a vent port extending through the barrel wall to the bore;

a gas conduit extending from the vent port to an occluding structure having a compression wave front impinging surface below the longitudinal axis of the bore and below the center of mass of the firearm, wherein the occluding structure and the conduit form a substantially closed chamber wherein the vent port, the gas conduit and the compression wave front impinging surface are arranged to guide a portion of the compression wave front from the bore to strike the compression wave front impinging surface to impart a given counter torque moment on the firearm counteracting the given associated torque moment applied by the compression wave front urging the projectile.

2. The apparatus of claim 1, wherein the compression wave front impinging surface of said occluding structure includes a plate.

3. The apparatus of claim 1, wherein the occluding structure includes a relief passage and a means for selectively setting a gas flow characteristic of said passage.

4. A method for counteracting a muzzle lift force of a firearm having a given center of mass and having a barrel with a barrel wall surrounding a bore extending along a longitudinal axis and having a structure for supporting a projectile and propellant for the projectile, and having a trigger mechanism for selectively igniting the propellant to form an expanding propellant gas having a given compression wave front urging the projectile through the bore and applying a given muzzle-lift torque moment on the firearm, comprising:

providing a gas conduit having at one end a fluidic connection through the barrel wall to the bore and, at an opposite end an an occluding structure, the gas conduit and the occluding structure forming a substantially closed chamber, wherein the occluding structure has a compression wave front impinging surface located below the the longitudinal axis of the bore and below the center of mass of the firearm, wherein providing said gas conduit includes arranging said gas conduit to guide a portion of the given compression wave front to strike the compression wave front impinging surface to impart a given counter-acting moment counter-acting said given muzzle lift torque moment.

5. The method of claim 4, wherein said occluding structure includes a movable plate.

6. The method of claim 4, wherein the occluding structure includes a passage and an adjustable constriction of said passage.

7. A muzzle lift compensated firearm having a given center of mass, comprising:

a frame;

a barrel supported by said frame, having a barrel wall surrounding a bore extending along a longitudinal axis, and having a breach end and a muzzle end, relief port extending from said bore through said barrel wall;

a support structure, proximal to said breach end of said barrel, to support a projectile and an ignitable propellant;

a trigger apparatus to selectively ignite said propellant to form a given compression wave front urging the projectile through the bore and applying a given associated muzzle-lift torque moment on the firearm, comprising;

a substantially closed chamber opening into the bore through the relief port, comprising a gas conduit extending from the relief port to a termination location below said longitudinal axis of the bore and below the center of mass of the firearm, the and an occluding structure located at said termination location wherein substantially closed chamber guides a portion of the given compression wave front to strike the occluding structure impart a given counter-acting torque moment counter-acting said given associated muzzle lift torque moment.

8. The firearm of claim 7, wherein said occluding structure includes a plate.

9. The firearm of claim 7, wherein the occluding structure includes a passage and an adjustable constriction of said passage.

10. The apparatus of claim 1, wherein the grip has a lower end distal below the barrel and the compression wave front impinging surface is located proximal to the lower end.

11. The method of claim 4 wherein the firearm further comprises a grip attached to the frame, having a lower end distal below the barrel, and wherein said providing a gas passage conduit provides the compression wave front impinging surface proximal to said lower end.

12. The firearm of claim 7 wherein the firearm further comprises a grip attached to the frame, having a lower end distal below the barrel, and wherein said occluding structure is proximal to said lower end.

* * * * *